US007032350B2

(12) United States Patent
Bienick et al.

(10) Patent No.: US 7,032,350 B2
(45) Date of Patent: Apr. 25, 2006

(54) WASHER DOOR OR LID DEFINED BY A TEMPERED GLASS PANEL BORDERED BY AN OPEN FRAME-LIKE ENCAPSULATION OF ONE-PIECE INJECTION MOLDED POLYMERIC/COPOLYMERIC SYNTHETIC PLASTIC MATERIAL

(75) Inventors: Craig Bienick, Jenison, MI (US); Howard Daley, Zeeland, MI (US)

(73) Assignee: Gemtron Corporation, Sweetwater, TN (US)

( * ) Notice: Subject to any disclaimer, the term of this patent is extended or adjusted under 35 U.S.C. 154(b) by 295 days.

(21) Appl. No.: 10/671,660

(22) Filed: Sep. 29, 2003

(65) Prior Publication Data

US 2004/0068951 A1 Apr. 15, 2004

Related U.S. Application Data

(62) Division of application No. 09/878,947, filed on Jun. 13, 2001, now Pat. No. 6,665,984.

(51) Int. Cl.
*E06B 3/00* (2006.01)

(52) U.S. Cl. ..... 49/501; 68/196

(58) Field of Classification Search ..... 49/501, 49/381, 383, 400, 397, 398, 401; 52/204.5, 52/171.1, 656.5; 68/196, 3 R, 12.01, 139, 68/140; 312/114, 138.1, 109, 326; 34/601, 34/602, 603, 595

See application file for complete search history.

(56) References Cited

U.S. PATENT DOCUMENTS 2,985,966 A * 5/1961 Martin ..... 34/75
3,843,982 A 10/1974 Lane et al.
4,336,301 A 6/1982 Shaw
4,543,283 A 9/1985 Curtze et al.
4,695,420 A 9/1987 Grawey et al.
4,732,553 A 3/1988 Hofer
4,750,302 A 6/1988 Bechtold
4,778,366 A 10/1988 Weaver
4,814,585 A * 3/1989 Klein ..... 219/545
4,824,190 A * 4/1989 Bartlett et al. ..... 312/138.1
4,831,780 A * 5/1989 Bockwinkel ..... 49/501
5,048,900 A * 9/1991 Nunn ..... 312/114
5,273,354 A 12/1993 Herrmann et al.
5,362,145 A 11/1994 Bird et al.
5,403,084 A 4/1995 Kane et al.
5,429,433 A 7/1995 Bird et al.
5,441,338 A 8/1995 Kane et al.
5,454,638 A 10/1995 Bird et al.
5,496,104 A * 3/1996 Arnold et al. ..... 312/204
5,540,493 A 7/1996 Kane et al.

(Continued)

FOREIGN PATENT DOCUMENTS

FR 2478688 3/1980

(Continued)

*Primary Examiner*—Hugh B. Thompson, II
(74) *Attorney, Agent, or Firm*—Diller, Ramik & Wight

(57) ABSTRACT

A washer door or lid as defined by a tempered glass panel bordered by an open frame-like encapsulation of one-piece injection molded polymeric/copolymeric synthetic plastic material. The latter material is preferably acrylonitrile/styrene/acrylate polymer blended with mica glass beads at a ratio of substantially 70%–30% to 90%–10% by weight, but preferably 80%–20% by weight. Further specifics of the washer lid include a relatively thick inner periphery of the encapsulation which securely grips and reinforces an outer peripheral edge of the tempered glass panel, a rigid outer peripheral skirt, an indiscrete handle, a reinforced hand corder for a switch actuator and opposite rear corners carrying hinges for securing the washer lid to an associated washer opening.

14 Claims, 4 Drawing Sheets

U.S. PATENT DOCUMENTS

| | | | |
|---|---|---|---|
| 5,735,589 | A | 4/1998 | Herrmann et al. |
| 6,095,625 | A | 8/2000 | Harris et al. |
| 6,146,574 | A | 11/2000 | Henkee et al. |
| 6,191,389 | B1 | 2/2001 | Rickert |
| 6,273,500 | B1 | 8/2001 | Boersma et al. |

FOREIGN PATENT DOCUMENTS

| | | | |
|---|---|---|---|
| GB | 2070130 A | * | 9/1981 |
| GB | 2118580 | | 11/1983 |
| GB | 2294698 | | 5/1996 |
| JP | 9-122332 | | 5/1997 |

* cited by examiner 50
30
31
40
39
34
50
31
23
32
21
32
14
13
16
16
12
13
18
11
10

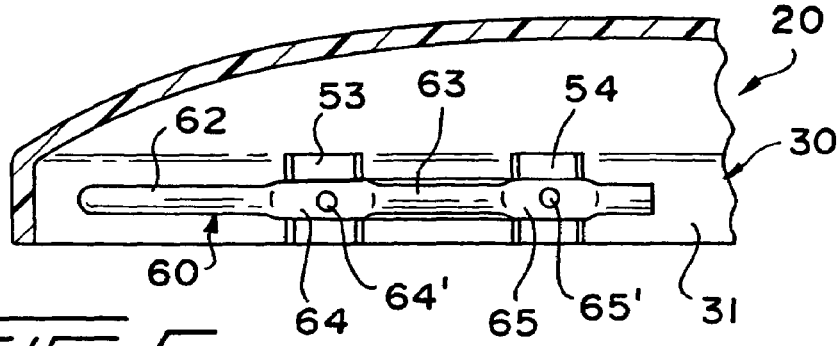
FIG. 6
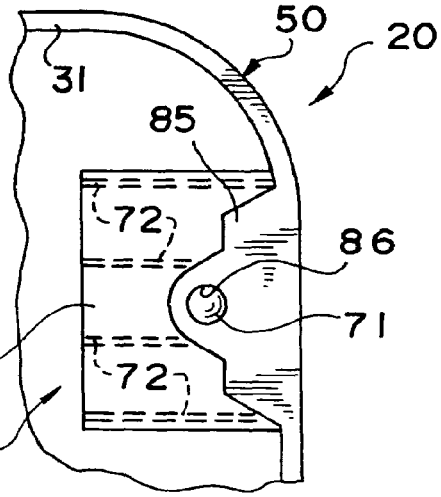
FIG. 7
FIG. 8
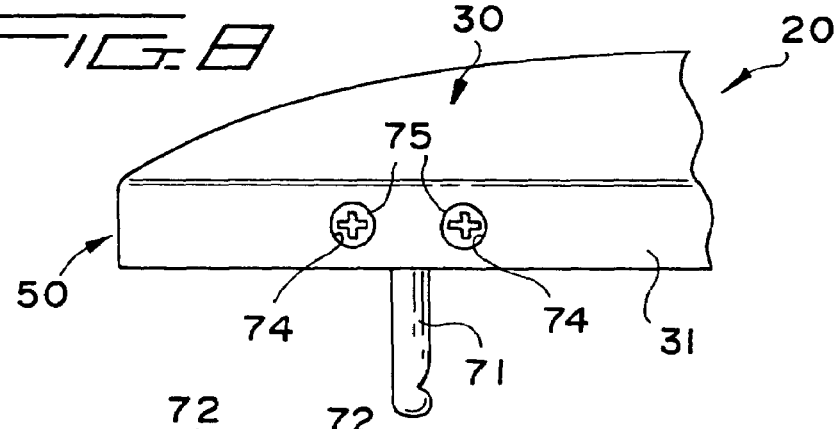
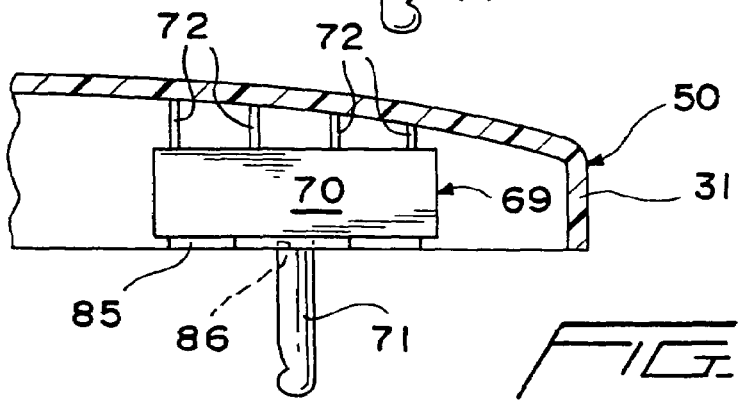
FIG. 9

WASHER DOOR OR LID DEFINED BY A TEMPERED GLASS PANEL BORDERED BY AN OPEN FRAME-LIKE ENCAPSULATION OF ONE-PIECE INJECTION MOLDED POLYMERIC/COPOLYMERIC SYNTHETIC PLASTIC MATERIAL

CROSS-REFERENCE TO RELATED APPLICATION

This application is a divisional application of Ser. No. 09/878,947 filed on Jun. 13, 2001, and now U.S. Pat. No. 6,665,984.

BACKGROUND OF THE INVENTION

The invention is directed to a door or lid which is normally hinged to a washer opening to define a top-loading or a front-loading washer. Conventionally such doors or lids have been made of metal with or without a glass panel through which the interior of the washer can be viewed.

DESCRIPTION OF THE RELATED ART

U.S. Pat. No. 4,695,420 granted on Sep. 22, 1987 and assigned to Caterpillar, Inc. makes reference to the desirability of injection molding plastic articles having a variety of complex shapes and sizes including panels and doors of vehicles or equipment enclosures, such as cab doors. Such cab doors were originally manufactured by utilizing a flat rigid frame fabricated from metal to which is unitized a window in what is termed a costly and time-consuming operation. The window or glazing is floated in a soft gasket channel isolated from the frame to reduce shock-loads and thermal stresses induced by varying coefficients of thermal expansion between the metal frame and the glazing/glass panel. It is believed that the process just described is workable because the window panes in all cases are sheets of transparent plastic material, such as polycarbonate and acrylic with the preferred material being a polycarbonate having a silicone hard coat applied thereto to make the polycarbonate glazing or window pane more scratch-resistant. The silicone hard coat on the peripheral edge is removed by sanding or grinding to assure good bonding between the eventually molded frame and the polycarbonate glazing.

With the advent of excellent molding qualities of modern plastic materials, an effort was made to form a door by first manufacturing a pre-shaped pane of transparent glass and subsequently integrally molding the latter into a door frame as the window thereof. Following this process, the window pane was distorted and wavy and the door frame had a tendency to warp. However, by utilizing a high modulus plastic material, such as polyurethane and a shrink-reducing filler material, undesired high temperature rise from exothermic reaction was moderated, particularly when a catalyst was added in sufficient amounts to control the weight of the reaction and the heat evolution. Also, by heating the glass and forming the frame by reaction injection molding, both the frame and the glass window pane thermally contract similarly absent window pane buckle and with bonding of the edges of the glass window pane to the frame.

Glass and specifically tempered glass have heretofore never been provided with an injection molded polymeric/copolymeric frame to form a door or lid, and particularly a washer lid. However, injection-molding polymeric/copolymeric material as an encapsulation or border to form a shelf is well known, as is evidenced by U.S. Pat. No. 5,273,354 granted on Dec. 28, 1993; U.S. Pat. No. 5,362,145 granted on Nov. 8, 1994; U.S. Pat. No. 5,403,084 granted on Apr. 4, 1995; U.S. Pat. No. 5,429,433 granted on Jul. 4, 1995; U.S. Pat. No. 5,441,338 granted on Aug. 15, 1995; U.S. Pat. No. 5,454,638 granted on Oct. 3, 1995; U.S. Pat. No. 5,540,493 granted on Jul. 30, 1996 and U.S. Pat. No. 5,735,589 granted on Apr. 7, 1998.

Other patents dealing with glass to which material is injection molded normally include windshields to which a gasket is molded and/or cured in situ so as to encapsulate a marginal peripheral edge of the windshield. Typical of such window assemblies and methods of forming the same are found in such patents as U.S. Pat. No. 4,778,366 granted on Oct. 18, 1998; U.S. Pat. No. 4,688,752 granted on Aug. 25, 1987 and U.S. Pat. No. 4,732,553 granted on Mar. 22, 1988.

Other patents which were located during the search of the instant invention include U.S. Pat. No. 4,543,283 granted on Sep. 22, 1987; U.S. Pat. No. 3,843,982 granted on Oct. 29, 1974; U.S. Pat. No. 6,146,574, granted on Nov. 14, 2000 and U.S. Pat. No. 4,336,301 granted on Jun. 22, 1982.

SUMMARY OF THE INVENTION

The present invention is specifically directed to a door or lid for a washer, but contrary to the door of U.S. Pat. No. 4,695,420, the transparent panel is constructed from tempered glass and an open frame-like encapsulation is preferably a polymeric/copolymeric synthetic plastic material in the form of acrylonitrile/styrene/acrylate polymer blended with mica glass beads at a ratio of substantially 70%–30% to 90%–10% by weight, but preferably 80%–20% by weight. The latter specifics of the blended material which is injection molded to form the open frame-like encapsulation achieves a much lower shrink ratio and elasticity, as compared to polypropylene which is normally used in the injection molding of a tempered glass substrate to form a shelf (not a door). Since tempered glass or a similar glass substrate has virtually a zero coefficient of expansion, the same obviously will not expand or contract in relationship to the expansion or contraction of conventional polymeric/copolymeric material, such as polypropylene. Consequently, typical "weld lines" created in the injection molded open frame-like encapsulation or border tend to fracture, particularly as such parts experience temperatures varying between −30° F. to +104° F. However, through the utilization of the specific blended materials latter defined at the ratios stated, such fracture has been essentially eliminated and the washer door or lid of the present invention achieves unexpected longevity, absent deterioration, and aesthetic characteristics at competitive prices, particularly at higher price-ranged washers.

The aesthetics of the washer lid are also enhanced by designing the exterior of the frame-like encapsulation which is exposed to the consumer as a relatively smooth, unbroken surface except as might otherwise be desired by a washer manufacturer who might specify a recess in the outer surface for reception of a decal, label or the like carrying trademark or other information. The interior of the washer lid which is less susceptible to scrutiny because of it being opened essentially only when the washer is being loaded or unloaded is engineered to include structural characteristics necessary for optimum functionality of the washer lid including, for example, an internally stepped relatively thick inner periphery of the frame-like encapsulation which securely grips and reinforces the peripheral edge of the tempered glass panel, an outboard depending peripheral skirt achieving exterior peripheral rigidity of the frame-like encapsulation, an indiscrete handle portion along an underside of a front wall of the encapsulation which is essentially unobservable when the washer lid is closed, a reinforced corner for a switch actuator, and opposite rear corners rigidly supporting hinges which are utilized to hinge the washer lid to an associated washer opening for movement between open and closed positions thereof.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 6 is an interior fragmentary side elevational view of the hinge of FIG. 4.

FIG. 7 is a fragmentary bottom plan view of a forward corner of the frame-like encapsulation, and illustrates a switch actuator seated upon reinforcing ribs projecting from a top panel of the frame-like encapsulation and being secured to the peripheral skirt by fasteners.

FIG. 8 is an outside fragmentary side elevational view of the forward corner illustrated in FIG. 7, and illustrates details of the switch actuator.

FIG. 9 is a fragmentary cross sectional view of the peripheral skirt of the corner of FIG. 7, and illustrates further details of the switch actuator.

DETAILED DESCRIPTION OF THE INVENTION

Figure 1:
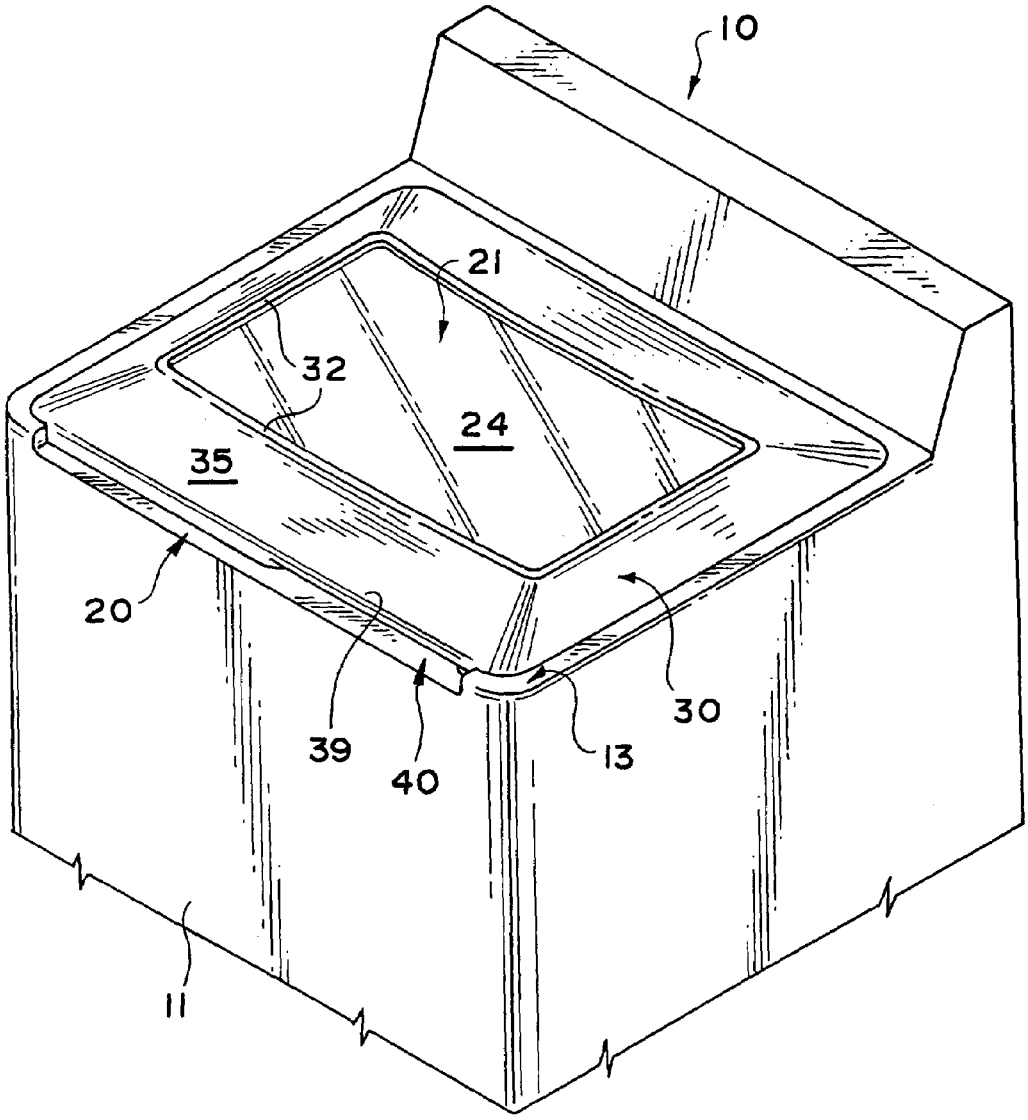
FIG. 1 is a fragmentary top perspective view, and illustrates a washer with a washer lid or door of the present invention hinged thereto in its closed position.
Figure 2:
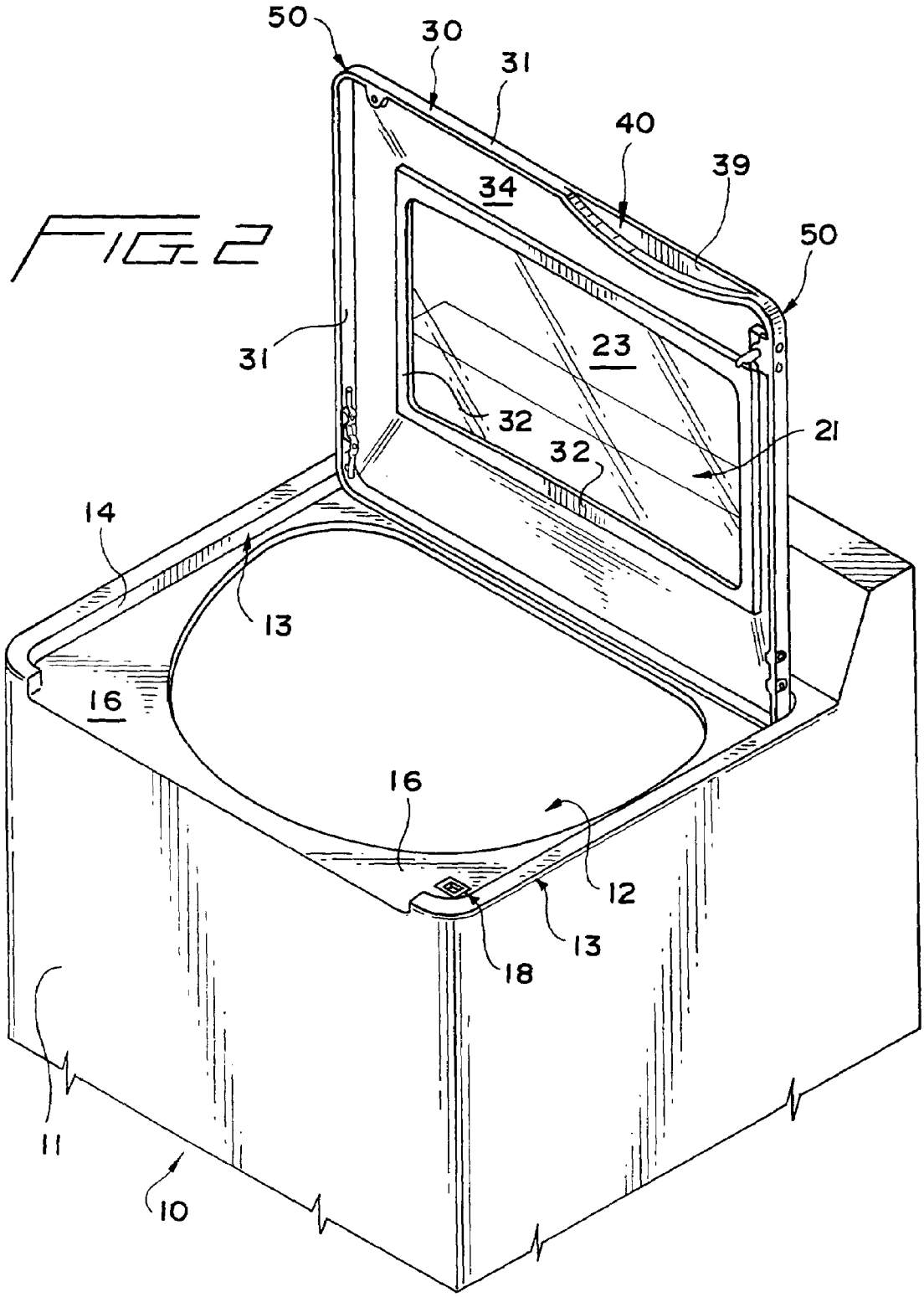
FIG. 2 is a fragmentary perspective view of the washer of FIG. 1, and illustrates the washer lid in its open position.

A washer 10 is illustrated in FIGS. 1 and 2 of the drawings and includes a conventional washer body 11 having an interior tub or chamber 12 including an upper frame 13 to which is hinged a novel washer lid or door 20 of the present invention. The upper frame 13 defines an upstanding inner peripheral wall 14 (FIGS. 2 and 4) at opposite rear corners (unnumbered) which the upper frame 13 is provided with openings 15 (FIG. 4) for hinging the washer lid 20 thereto in a manner to be described more fully hereinafter.

A conventional agitator (not shown) is mounted in the tub or chamber 12 and reciprocates arcuately in a conventional fashion. A conventional safety switch or "ON"/"OFF" switch 18 (FIG. 2) is carried by and beneath an apertured horizontal frame portion 16 of the upper frame 13 of the washer 10, and is switched "on" and "off" by the washer lid 20 in a manner to be described more filly hereinafter.

The washer lid or door 20 includes a tempered glass panel 21 of a predetermined peripheral configuration defined by a substantially continuous peripheral edge 22. The glass panel 21 further includes opposite inner and outer surfaces 23, 24, respectively, bridged by the peripheral edge 22. A peripheral portion 25 of the glass panel 21 is defined by the peripheral edge 22 and immediately adjacent surface portions of the opposite inner and outer surfaces 23, 24, respectively.

An open frame-like encapsulation or border 30 is formed as a one-piece of injection molded polymeric/copolymeric synthetic plastic material. The polymeric/copolymeric synthetic plastic material is preferably acrylonitrile-styrene-acrylate polymer blended with mica glass beads at a ratio of substantially 70%–90% of the polymer and substantially 30%–10% of the mica glass beads, respectively, by weight. The preferable range by weight of the blend is substantially 80% of the polymer to substantially 20% of the mica glass beads. The latter ranges of the polymer and the mica glass beads achieve an extremely low shrink ratio and elasticity, as compared to polypropylene. As the injection molded blended polymer of the open frame-like encapsulation 30 cools, its virtually minimal shrink ratio parallels the almost zero coefficient of expansion of the tempered glass panel 21. Consequently, weld lines of the injection molded frame-like encapsulation 30 will not fracture, particularly when subject to temperature anywhere between −30° F. to 140° F.

The open frame-like encapsulation 30 includes an outer peripheral portion 31 and an inner peripheral portion 32 with the inner peripheral portion 32 entirely encapsulating the glass panel outer peripheral portion 25 including the peripheral edge 22 and immediately adjacent surface portions of the opposite inner and outer surfaces 23, 24, respectively. The frame-like encapsulation 30 further includes an inner or lower surface 34 and an outer or upper surface 35 defining therebetween the overall inner and outer surface configurations of the frame-like encapsulation 30 and the wall thickness thereof. The frame-like encapsulation inner surface 35 is stepped (FIG. 2) at the frame-like inner peripheral portion 32 and defines thereat a relatively thicker wall thickness than the wall thickness at the outer peripheral portion 31. However, the outer surface 34 has a configuration which is substantially continuous and unstepped which presents an aesthetic appearance to the washer lid 20 when in the closed position (FIG. 1), and all remaining injection-molded characteristics are formed along the inner surface 35 and are hidden from view (FIG. 1) except, of course, when the washer lid 20 is opened (FIG. 2).

The outer peripheral portion 31 of the washer lid 20 is defined as continuously downward depending peripheral wall or skirt which is smooth and unbroken except along a front edge (unnumbered) of the frame-like encapsulation 30. At the front edge (FIGS. 1–3) of the frame-like encapsulation 30 a curved wall portion 38 (FIGS. 2 and 3) of the depending skirt 31 is recessed inwardly and opens concavely outwardly to define a handgrip recess 40 in association with an overlying ledge or lip 39 of the frame-like encapsulation 30. In order to open the washer lid 20, a person merely inserts one or more fingers within the handgrip area 40 (FIG. 1) and lifts upwardly against the ledge 39 to pivot the washer lid 20 from the position shown in FIG. 1 to the position shown in FIG. 2.

Figure 4:
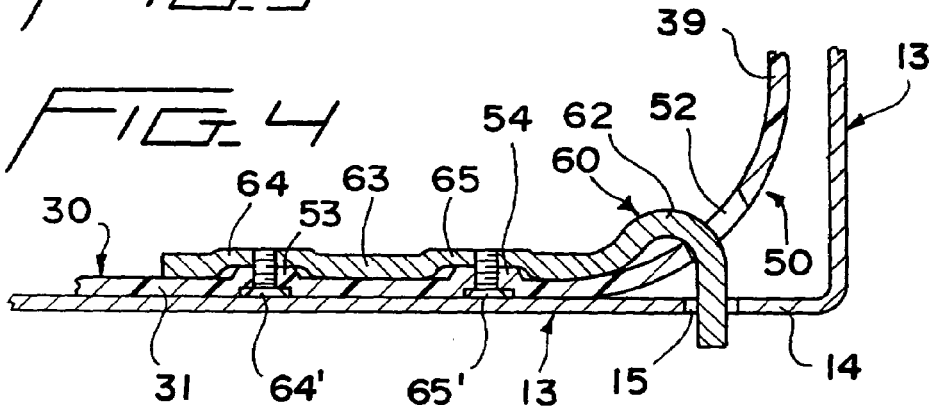
FIG. 4 is a fragmentary cross sectional view through a corner portion of two identical rear corners of the washer lid, and illustrates a generally L-shaped hinge defined by a mounting portion and a pintle portion with the former being fastened to a depending peripheral skirt of the frame-like encapsulation and the pintle portion passing through a slot of the depending peripheral skirt.
Figure 5:
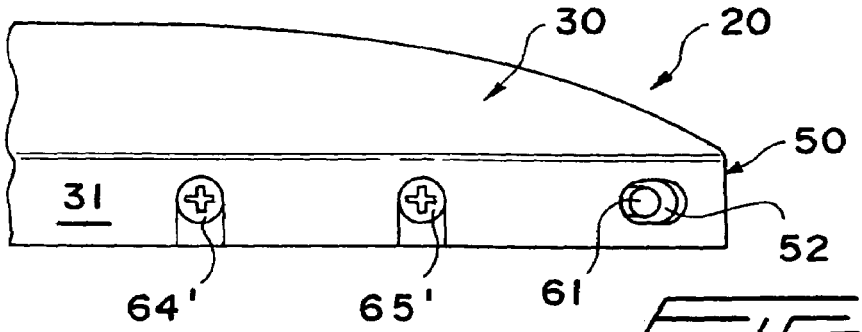
FIG. 5 is an exterior fragmentary side elevational view of the hinge of FIG. 4, and illustrates the details thereof.

The frame-like encapsulation 30 also includes substantially identical corner portions 50, 50 (FIGS. 1 and 4) defined by the peripheral skirt 31 with a radius (unnumbered) of each corner portion 50 including an elongated curved slot or opening 52 (FIGS. 4 and 5). Two bosses 53, 54 project inwardly of the peripheral skirt 31 and each includes a respective bore 55, 56. Hinge means in the form of a hinge pin 60 is associated with each corner portion 50 and is of a generally L-shaped configuration defined by a pintle portion 61 connected by a radius portion 62 to a mounting portion 63 which includes respective flattened recessed portions 64, 65 seated upon and receiving therein the bosses 53, 54, respectively. Threaded fasteners 64', 65' are fed through bores (unnumbered) of the bosses 53, 54 and are threaded into threaded openings (unnumbered) of the flattened portions 64, 65, respectively, of the mounting portion 63 of each hinge 60 thereby rigidly attaching each of the hinges 60 to the peripheral skirt 31 adjacent an associated one of the rear corner portions 50. The pintle portions 61 of the hinge pins 60 lie in coaxial relationship to each other and project in opposite directions. Each pintle portion 61 is fitted in one of the openings 15 (FIG. 4) of the inner peripheral wall 14 of the upper frame 13 of the washer body 11 to thereby permit pivoting movement of the washer lid 20 between the positions shown in FIGS. 1 and 2 of the drawings.

At the corner portion 50 adjacent the hand recess 40 (FIGS. 3, 7, 8 and 9), a one-piece molded switch-actuator mechanism 69 defined by a mounting block 70 having a switch actuator leg 71 rests upon four substantially parallel relatively spaced reinforcing ribs 72 which project downwardly from the inner surface 34 of the frame-like encapsulation 30. The peripheral skirt 31 in the area of the ribs 72 includes two bores 74 through which pass fasteners 75 which are threaded into the mounting block 70 to rigidly secure the same in the manner illustrated in FIGS. 7 through 9 of the drawings. The leg 71 of the switch-actuating mechanism 69 is aligned with the safety "ON"/"OFF" switch 18 to close the latter when the washer lid 20 is closed (FIG. 1) and open the latter when the washer lid 20 is open (FIG. 2) to respectively start and stop the washer agitator (not shown) in a conventional manner.

Figure 3:
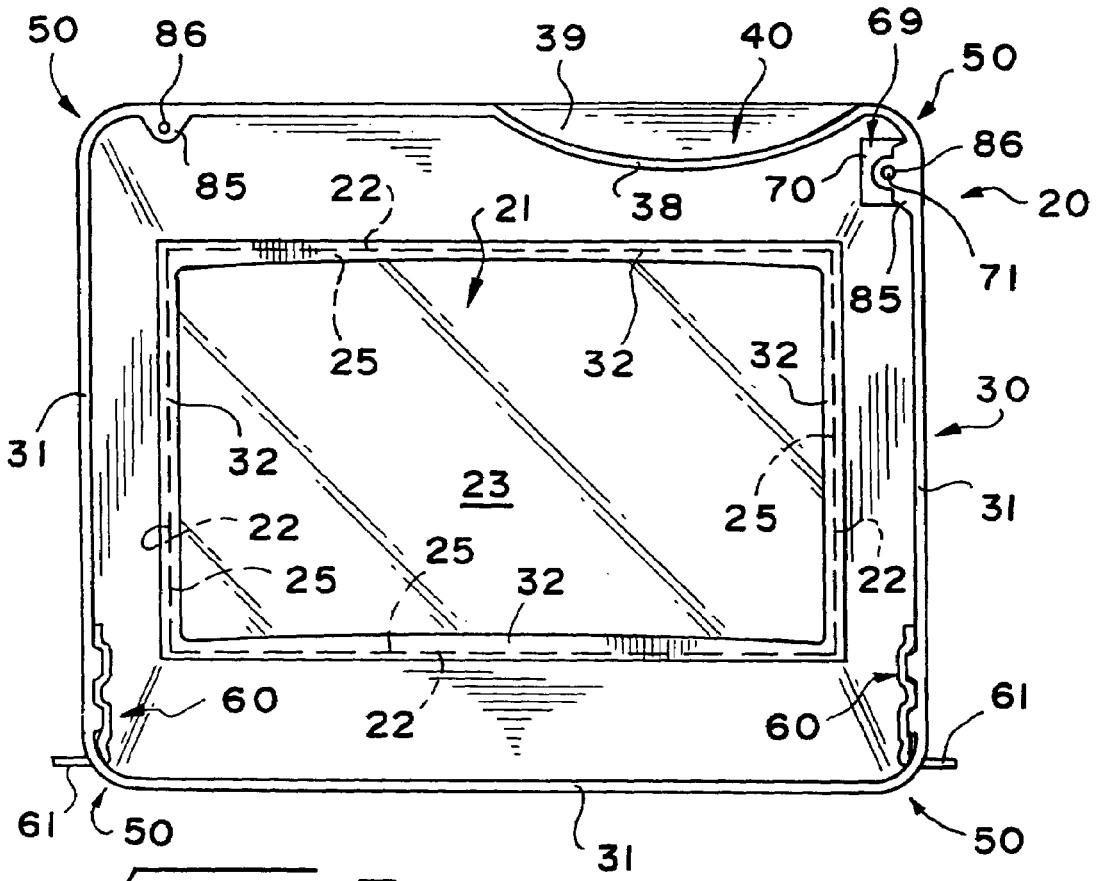
FIG. 3 is a bottom plan view of the washer lid or door, and illustrates a tempered glass panel bonded by an open frame-like encapsulation formed of one-piece injection molded polymeric/copolymeric plastic material.

A substantially inwardly directed flange 85 is located at each of the front corners 50, 50 of the washer lid 20 in spaced relationship to the inner surface 34 (FIGS. 3, 7 and 9). The flange 85 illustrated at the upper left hand corner 50 of FIG. 3 includes an opening 86 carrying a rubber or similar flexible stop (not shown) which contacts and rests upon the horizontal frame portion 16 of the upper frame 13 of the washer body 11 when the washer lid 20 is in the closed position thereof (FIG. 1). The leg 71 of the switch-actuating mechanism 69 passes through and is radially supported by the opening 86 of the flange 85 (FIGS. 7 and 9).

As is most readily apparent from FIG. 1 of the drawings, the washer lid 20 presents an extremely aesthetic appearance to the overall washer 10 due to the relatively smooth and unbroken upper/outer surface 35 of the encapsulation 30. Even in the open position (FIG. 2) of the washer lid 20, the interior of the washer lid 20 is relatively aesthetic in appearance since the hinges 60, 60 are unobtrusive, as is the design and location of the switch block 69 which is partially hidden by the flange 85 (FIG. 7). However, most important is the fact that, even though the panel 21 is constructed from glass, the specific blend of the polymer and the mica glass beads from which the frame-like encapsulation 30 is injection molded achieves an intimate bond between the components, absent fracture or weakening of the encapsulation 30 due to the similarities between the low shrink ratios and elasticities of these materials. Since the tempered glass panel 21 has almost a zero coefficient of expansion, there will obviously not be any material of the expansion or contraction of the same relative to the injected polymeric/copolymeric material of the encapsulation 30 at temperatures ranging between −30° F. to −140° F., temperatures which heretofore would cause injection molded polypropylene to fracture. Hence, a strong, durable and aesthetic acceptable washer lid 20 is achieved by the present invention, though usage is as other than a washer lid is well within the breadth of the present disclosure.

Although a preferred embodiment of the invention has been specifically illustrated and described herein, it is to be understood that minor variations may be made in the apparatus without departing from the spirit and scope of the invention, as defined by the appended claims.

What is claimed is:

1. A door comprising a tempered glass panel of a redetermined peripheral configuration defined by a substantially continuous peripheral edge, said panel further including opposite inner and outer surfaces bridged by said peripheral edge, a peripheral portion of said glass panel being defined by said peripheral edge and immediately adjacent surface portions of said opposite inner and outer surfaces, an open frame encapsulation of one-piece injection molded polymeric/copolymeric synthetic plastic material, said open frame encapsulation including an outer peripheral portion and an inner peripheral portion, said frame inner peripheral portion entirely encapsulating said glass panel peripheral portion including said peripheral edge and said immediately adjacent surface portions of said opposite inner and outer surfaces, said frame encapsulation further including inner and outer surfaces defining therebetween respective inner and outer surface configurations of the frame encapsulation and the wall thicknesses thereof, said frame outer peripheral portion defining a depending peripheral skirt opening in a direction away from an annular top wall of said frame encapsulation, a switch actuator supported against said top wall, and fastener means for securing said switch actuator against said top wall.

2. The door as defined in claim 1 wherein said annular top wall includes means for reinforcing said annular top wall at said switch actuator.

3. The door as defined in claim 2 wherein said reinforcing means are a plurality of ribs.

4. The door as defined in claim 2 wherein said reinforcing means are a plurality of substantially parallel spaced ribs.

5. The door as defined in claim 1 wherein said reinforcing means are a plurality of ribs against which rests said switch actuator.

6. The door as defined in claim 5 wherein said fastener means include at least one fastener passed through an opening of said depending peripheral skirt.

7. The door as defined in claim 1 wherein said fastener means include at least one fastener passed through an opening of said depending peripheral skirt.

8. The door as defined in claim 1 wherein said fastener means include at least one fastener passed through an opening of said depending peripheral skirt and secured to said switch actuator.

9. A door/lid for an appliance comprising a tempered glass panel of a predetermined peripheral configuration defined by a substantially continuous peripheral edge, said panel further including opposite inner and outer surfaces bridged by said peripheral edge, a peripheral portion of said glass panel being defined by said peripheral edge and immediately adjacent surface portions of said opposite inner and outer surfaces, an open frame formed at least in part as a one-piece molded encapsulation of polymeric/copolymeric synthetic plastic material, said open frame including an outer peripheral portion and an inner peripheral portion, said open frame inner peripheral portion entirely encapsulating said glass panel peripheral portion including said peripheral edge and said immediately adjacent surface portions of said opposite inner and outer surfaces, and means at said frame outer peripheral portion for hinging said door to an associated appliance, and said frame further including a means for actuating a switch of an appliance with which said appliance door/lid is adapted to be associated.

10. The appliance door/lid as defined in claim 9 wherein said open frame is constructed entirely as a one-piece injection molded encapsulation.

11. A door/lid for an appliance comprising a tempered glass panel of a predetermined peripheral configuration defined by a substantially continuous peripheral edge, said panel further including opposite inner and outer surfaces bridged by said peripheral edge, a peripheral portion of said glass panel being defined by said peripheral edge and immediately adjacent surface portions of said opposite inner and outer surfaces, an open frame formed at least in part as a one-piece molded encapsulation of polymeric/copolymeric synthetic plastic material, said open frame including an outer peripheral portion and an inner peripheral portion, said open frame inner peripheral portion entirely encapsulating said glass panel peripheral portion including said peripheral edge and said immediately adjacent surface portions of said opposite inner and outer surfaces, said open frame further including inner and outer surfaces defining therebetween respective inner and outer surfaces configurations of the frame encapsulation and wall thicknesses thereof, means at one side of said frame for pivotally securing said door/lid to an appliance, and means at another side of said frame for providing a finger gripping portion of said door/lid to facilitate gripping thereof when said door/lid is associated with an appliance, and further including a means for actuating a switch of an appliance with which said appliance door/lid is adapted to be associated.

12. The appliance door/lid as defined in claim 11 wherein said open frame is constructed entirely as a one-piece injection molded encapsulation.

13. A door/lid for an appliance comprising a tempered glass panel of a predetermined peripheral configuration defined by a substantially continuous peripheral edge, said panel further including opposite inner and outer surfaces bridged by said peripheral edge, a peripheral portion of said glass panel being defined by said peripheral edge and immediately adjacent surface portions of said opposite inner and outer surfaces, an open frame formed at least in part as a one-piece molded encapsulation of polymeric/copolymeric synthetic plastic material, said open frame including an outer peripheral portion and an inner peripheral portion, said open frame inner peripheral portion entirely encapsulating said glass panel peripheral portion including said peripheral edge and said immediately adjacent surface portions of said opposite inner and outer surfaces, and said frame includes means fro defining a hand grip area for facilitating opening and closing of the appliance door/lid, said frame further including a means for actuating a switch of an appliance with which said appliance door/lid is adapted to be associated.

14. The appliance door/lid as defined in claim 13 wherein said open frame is constructed entirely as a one-piece injection molded encapsulating.

* * * * *